United States Patent [19]

McCullough, Jr. et al.

[11] Patent Number: 4,943,478

[45] Date of Patent: Jul. 24, 1990

[54] SEAT CUSHIONS

[75] Inventors: Francis P. McCullough, Jr., Lake Jackson; R. Vernon Snelgrove, Damon, both of Tex.

[73] Assignee: The Dow Chemical Company, Midland, Mich.

[21] Appl. No.: 206,636

[22] Filed: Jun. 14, 1988

Related U.S. Application Data

[63] Continuation-in-part of Ser. No. 114,324, Oct. 28, 1987, Pat. No. 4,879,168.

[51] Int. Cl.[5] ..... B32B 9/00; B27N 9/00; D03D 13/00

[52] U.S. Cl. ..... 428/288; 428/289; 428/290; 428/367; 428/371; 428/408; 428/920; 428/921

[58] Field of Search ..... 428/367, 408, 288, 198, 428/290, 371, 362, 920, 921, 289, 292, 293

[56] References Cited

U.S. PATENT DOCUMENTS

| | | | |
|---|---|---|---|
| 3,993,829 | 11/1976 | Park | 428/408 X |
| 4,356,228 | 10/1982 | Kobayashi et al. | 428/408 X |
| 4,460,650 | 7/1984 | Ogawa et al. | 428/394 X |
| 4,565,727 | 1/1986 | Ciglia et al. | 428/408 X |
| 4,659,616 | 4/1987 | Cordier | 428/281 |
| 4,783,349 | 11/1988 | Cogswell et al. | 428/367 X |
| 4,788,104 | 11/1988 | Adriaensen et al. | 428/367 X |

FOREIGN PATENT DOCUMENTS

| | | |
|---|---|---|
| 8606110 | 10/1986 | PCT Int'l Appl. . |
| 2152541 | 8/1985 | United Kingdom . |

OTHER PUBLICATIONS

PCT 86/06110, Published, 10/23/86, by McCullough et al.

*Primary Examiner*—Lorraine T. Kendell

[57] ABSTRACT

A non-linear fire retarding and fire blocking covering for a foam seat cushion structure comprising an intimate blend of a binder and 25–75% by weight of fibers comprising heat set carbonaceous fibers having a LOI value greater than 40, said carbonaceous fibers being derived from heat treated stabilized polymeric fibers or pitch based fibers.

13 Claims, No Drawings

SEAT CUSHIONS

RELATED APPLICATIONS

This application is a continuation-in-part of application Ser. No. 114,324, filed Oct. 28, 1987, now U.S. Pat. No. 4,879,168 of McCullough et al, entitled "Flame Retarding and Fire Blocking Fiber Blends".

FIELD OF THE INVENTION

The present invention relates to foam seat cushion coverings and upholstering having flame retarding and fire barrier characteristics. More particularly, the invention is concerned with foam seat cushions with non-woven coverings comprising a blend of carbonaceous fibers with a binder, and structures containing such coverings.

BACKGROUND OF THE INVENTION

Both government and industry have conducted extensive research into developing fabrics for the seat cushions of airplanes that would either be non-flammable or at least retard the propagation of a fire. In conjunction with finding an effective material to act as a fire barrier, consumer considerations require that any such materials be functional, aesthetically acceptable and reasonably priced. Suitable barriers do exist such as needle punched aramids, however, these barriers are difficult to cut and sew, heavy and often provide less than desired comfort.

Unfortunately, past efforts to develop a suitable fire barrier have not been very effective. Thus, even fabrics that will not ignite from a smoldering cigarette and that are considered to be class 1 fabrics under the UFAC upholstery fabric classification test will burn when placed in contact with an open flame. Consequently, this leads to the ignition of an underlying foam cushion.

Inherently, flame-retardant fibers are well-known to those skilled in the art. These fibers, known as matrix fibers, though useful because of their flame-retardant qualities, are not strong enough to form their own fabrics, tend to have a non-uniform composition, are not succeptible of being easily dyed, and, in general, are not alone suitable for production into fabrics to form coverings for seat cushions. On the other hand, conventional natural and synthetic fibers (staple fibers) which are alone suitable for production into seat cushions are not inherently flame-retardant.

Many types of flame resistant fabrics, i.e., fabrics which are self-extinguishing when the ignition source is removed, have been provided by the prior art. For example, fabrics of normally flammable fibers, e.g., cotton, rayon, etc. have been treated with innumerable flame resistant surface coating compositions. More recently, flame resistant fabrics have been prepared from either normally flammable synthetic fibers, e.g., rayon, polyolefins, polyesters, acrylics, etc., which have been spun with flame retardant additives or from other synthetic fibers which are spun from polymers which are inherently flame resistant, e.g., polyvinylchloride, polytetrafluoroethylene, polymetaphenyleneisophthalamide. Although such flame resistant fabrics have found substantial application in carpets, draperies, upholstery, etc. and also in garments such as costumes, sleepwear, etc. where flame propagation from inadvertently applied ignition sources is to be avoided, in general, such fabrics are not satisfactory for upholstery or seat cushion covering, especially for airplanes, since they exhibit shrinkage or rapid break open on exposure to intense heat fluxes. The art has provided a limited number of super-high-temperature organic polymeric fibers, e.g., polybenzimidazoles, polyoxadiazoles, polyparaphenylene terephthalamide and certain heat-treated/cyclized acrylic, which in fabric form can survive intense thermal fluxes, at least for a worthwhile interval. However, such fabrics also exhibit one or more negatives, such as limited durability (poor abrasion resistance, low flex life) and poor dyeability. In some instances the polymer used for the fiber of the fabric is inherently highly colored.

It is not sufficient that the fabric merely be flame resistent and possess abrasion resistance. To be completely acceptable, the fabric must also be lightweight, conformable, nonscratchy, durable in normal use, dyeable, etc. in order that the seat covering made therefrom will be sufficiently comfortable and aesthetically attractive.

European Patent Application 0199567 of McCullough, et al discloses non-linear carbonaceous fibers which are used in the structures and fabrics of the present invention.

The carbonaceous fibers of the invention according to the test method of ASTM D 2863-77 have a LOI value greater than 40.

The term "Reversible Deflection" as used herein applies to a helical or sinusoidal compression spring. Particular reference is made to the publication "Mechanical Design—Theory and Practice", MacMillan Publ. Co., 1975, pp 719 to 748; particularly Section 14–2, pages 721–24.

SUMMARY OF THE INVENTION

In accordance with the present invention there is provided lightweight flame retarding and flame shielding or blocking non-woven fabric structures for foam seat cushion coverings comprising about 25–75% by weight of linear and/or non-linear carbonaceous fibers having a carbon content of at least 65%, derived from heat set stabilized polymeric fibers or a pitch based fiber and a binder. The seat covering structure advantageously comprises an intimate blend of a suitable binder, preferably polyester, and non-flammable linear or non-linear carbonaceous filaments having a reversible deflection ratio of greater than 1.2:1, preferably greater than 2.0:1, and an aspect ratio (1/d) greater than 10:1. The non-linear fibers have been found more advantageous since they provide considerable porosity which inhibits the spread of fire. Both linear and non-linear carbonaceous fibers have a LOI value greater than 40.

Furthermore, it has been surprisingly found that the carbonaceous fibers when intimately blended with a polyester results in a synergistic effect with respect to fire blocking and fire retarding properties as well as holding back molten urethane of the seat cushion when intense heat and flame is applied to the covered cushion. The fabric structure of the invention is especially used to prevent the sideways propagation of fire.

DETAILED DESCRIPTION OF THE INVENTION

In accordance with the invention, it has been surprisingly discovered that a foamed seat cushion can be provided with a non-woven covering comprising carbonaceous polymeric fibers having an LOI value of greater than 40 which are intimately blended with a suitable binder which provides a synergistic improvement in the fire retarding and fire blocking characteristics of the resulting structure. Even more significant results are achieved when the carbonaceous fibers are non-linear fibers, have a reversible deflection ratio of greater than 1.2:1 and an aspect ratio (1/d) greater than 10:1. Both the linear and non-linear fibers can be utilized in connection with the present invention. When the carbonaceous fibers are non-linear the gap between the fibers provides the porosity in the event of fire which suppresses smoldering. It is understood that the greater the amount of non-linear carbonaceous fibers which are utilized, the better will be the reforming and fire retarding characteristics of the structure.

The non-linear carbonaceous fibers which are utilized may have a sinusoidal and/or a coil-like configuration depending upon the ultimate use of the fibers. The acrylic derived carbonaceous fibers have a nitrogen content in which the nitrogen content is between 18 and 20% are especially useful for fabrics making skin contact with the wearer.

The fabrics may comprise a blend of all natural, all synthetic or a combination of both together with the carbonaceous fibers.

The natural fibers wherein the synergistic effect is found when used in a blend with the carbonacecus fibers of the invention include cotton, wool, flax and silk.

The synthetic fibers which can be utilized to form a blend with the carbonaceous fibers of the present invention include polyolefins, for example, polyethylene, polypropylene and the like, polyvinyl chloride, polyvinyl alcohol, polyesters, polyacrylonitrile, polyacrylates, polycarbonate, cellulosic products, ionomers, DACRON (Trademark), KEVLAR (Trademark), and the like. It is to be understood of course, that a blend of natural and/or synergistic fibers with the carbonaceous fibers may be used.

The binders utilized in the present invention comprise any of the conventional thermal bonding fibers such as Kodel 410 of Eastman Chemical, a polyethylene binder having a flow point of 8 denier at 88° C., Dacron D171W of E.I. du Pont de Nemours, PRIMACOR 400 (trademark of The Dow Chemical Company for low melting polyethylene acrylic acid copolymer fibers, and the like.

Exemplary of the products which can be structures of the present invention are set forth in the following examples. It is understood that the percentages referred to herein relate to percent by weight.

EXAMPLE 1

A. Battings were made by blending an appropriate weight percent of each respective opened fiber in a blender/feed section of a sample size 40"Rando Webber Model D manufactured by Rando Machine Corp. of Macedon, N.Y. The battings produced typically were 1 inch (2.54 cm) thick and had bulk densities in a range of from 0.2 to 1 lb/cc ft. The battings were thermally bonded by passing the Rando batting on a conveyor belt through a thermal bonding oven at a temperature of about 200° C. together with a low melting resistant polyester. The result was a fire resistant non-woven fabric which could be utilized for coverings for the foam of airline seat cushions.

EXAMPLE 2

Non-Flammability Test

The non-flammability of the fabric of the invention has been determined following the test procedure set forth in 14 CFR 25.853(b), which is herein incorporated by reference. The test was performed as follows:

A minimum of three 1"×6"×12"(2.54 cm ×15.24 cm ×30.48 cm) specimens comprised of 70% carbonaceous fiber −25% polyester −5% wool were conditioned by maintaining the specimens in a conditioning room maintained at 70 degrees ±5 degrees F. temperature and 50% ±5% relative humidity for 24 hours preceding the test.

Each specimen was supported vertically and exposed to a Bunsen or Turill burner with a nominal I.D. tube adjusted to give a flame of 1½ inches (3.81 cm) in height by a calibrated thermocouple pyrometer in the center of the flame was 1550 degrees F. The lower edge of the specimen was ¾ inch (1.91 cm) above the top edge of the burner. The flame was applied to the center line of the lower edge of the specimens for 12 seconds and then removed.

Pursuant to the test, the material was self-extinguishing. The average burn length did not exceed 8 inches (20.32 cm). The average after flame did not exceed 15 seconds and there were no flame drippings.

EXAMPLE 3

A. Battings were made by blending an appropriate weight percent of each respective opened fiber in a blender/feed section of a sample size 12" Rando Webber Model B manufactured by Rando Machine Machine Corp. of Macedon, N.Y. The battings produced typically were 1 inch (2.54 cm) thick and had bulk densities in a range of from 0.4 to 6 lb/cc ft (6.4 cm to 96 kg/cc $m^3$). The battings were thermally bonded by passing the Rando batting on a conveyor belt through a thermal bonding oven at a temperature of about 300° C.

Flammability tests were run in a standard apparatus as cited in FTM 5903 according to the procedure of FAR 25.853b which references FTM 5903. The results are shown in the following Table I:

TABLE I

| Sample No. | Sample Composition | % Wt. | Burn Length (in.) | After Flame (Sec.) | Flame Drop Time (Sec.) | Pass or Fail |
|---|---|---|---|---|---|---|
| 1 | NCF/PEB/PE | 10/20/70 | 2/1/1 | 0/0/0 | 0/0/0 | passed |
| 2 | NCF/PEB/PE | 20/20/60 | .75/.75/.75 | 0/0/0 | 0/0/0 | passed |
| 3 | NCF/PEB/PE | 25/20/55 | .75/.75/.75 | 0/0/0 | 0/0/0 | passed |
| 4 | NCF/PEB/PE | 30/20/50 | .5/.5/.5 | 0/0/0 | 0/0/0 | passed |
| 5 | NCF/PEB/PE | 40/20/40 | .5/.5/0 | 0/0/0 | 0/0/0 | passed |
| 6 | NCF/PEB/PE | 5/20/75 | complete | 20 sec. | 0/0/0 | failed |
| 7 | NCF/PEB/PE | 50/20/30 | 0/0/0 | 0/0/0 | 0/0/0 | passed |
| 8 | OPF/PEB/PE | 10/20/70 | complete | 20 sec. | 0/0/0 | failed |
| 9 | LCF/PEB/PE | 50/20/30 | .25/.25/.25 | 0/0/0 | 0/0/0 | passed |
| 10 | NCF/PEB/cotton | 10/10/80 | .5/.5/.5 | 0/0/0 | 0/0/0 | passed |
| 11 | Nomex TM /PEB/PE | 20/20/60 | complete | 38 sec. | 0/0/0 | failed |
| 12 | Nomex TM /PEB/PE | 50/20/30 | complete | 30 sec. | 0/0/0 | failed |

TABLE I-continued

| Sample No. | Sample Composition | % Wt. | Burn Length (in.) | After Flame (Sec.) | Flame Drop Time (Sec.) | Pass or Fail |
|---|---|---|---|---|---|---|
| 13 | NCF/PEB/Cotton | 10/15/75 | .75/.75/.5 | 0/0/0 | 0/0/0 | passed |
| 14 | NCF/PEB/Cotton | 5/15/80 | 12 | 14 | — | failed |
| 15 | NCF/PEB/PE | 5/20/75 | 12 | 195 | 0/0/0 | failed |
| 16 | NCF/PEB/PE | 7.5/20/72.5 | 2/10/2 | 0/7/0 | 0/0/0 | borderline |
| 17 | LFC/PEB/Cotton | 25/15/60 | 1/1.25/1 | 0/0/0 | 0/0/0 | passed |
| 18 | OPF/PEB/Cotton | 50/15/35 | 14 | 3 sec. | 0/0/0 | failed |
| 19 | NCF/PEB/Cotton | 20/15/65 | .75/.75/.75 | 0/0/0 | 0/0/0 | passed |
| 20 | NCF/PEB/Wool | 5/15/80 | 10 | 5 | 0/0/0 | failed |
| 21 | NCF/PEB/Wool | 10/15/75 | 1.25/1/1 | 0/0/0 | 0/0/0 | passed |
| 22 | NCF(sc)/PEB/Cotton | 20/15/65 | 1/1/.75 | 1/.5/0 | 0/0/0 | passed |
| 23 | OPF/PEB/PE | 50/20/30 | 12 | 8/8 | 0/0/0 | failed |

NCF=non-linear carbonaceous fiber
LCF=linear carbonaceous fiber
LCF(SC)=linear carbonaceous fiber with small amplitude crimp
PEB=8 denier polyester binder fiber of 410 KODEL (Trademark)
PP=polypropylene
PE=6 denier 2" staple Dupont DACRON (Trademark) 164 FOB polyester
Cotton=non-treated 1½" cotton
OPF=stabilized polyacrylonitrile fiber
NOMEX=trademark of an aramid fiber available from E.I. de Pont & Co.

The above table shows surprisingly that use of as little as 7.5% by weight of carbonaceous fibers in the blends resulted in substantially no after flame when the flame source was removed and no flame drippings.

The battings with sufficient binder and under pressure could be made into non-woven fabrics which are suitable for use in the present invention.

Following the procedure of Example 3 a similar tests were performed and the results are shown in the following Table II.

oz/y.d$^2$ and a non-woven fabric consisting of 20% carbonaceous fibers of the invention and 80% polyester binder composed of a 3:1 ratio of high melt polyester binder to low melt polyester binder. The cushions were conditioned for 24 hours and the flames were set for 2 minutes.

| | Test 1 | Test 2 | Test 3 |
|---|---|---|---|
| initial wt. | 21.84 | 21.83 | 21.84 |
| weight/cushions | 26.93 | 26.98 | 27.07 |
| Initial system wt. | 5.09 | 5.15 | 5.23 |
| Final wt. | 26.51 | 26.80 | 26.81 |
| weight loss | 0.42 | 0.18 | 0.26 |
| % wt. loss | 8.25 | 3.50 | 4.97 |
| char length | 15.0 | 10.0 | 12.0 |

B. Vertical burn test results.

| | Dress Cover | | Blocking Layer | |
|---|---|---|---|---|
| | Burn Time | Burn Length | Burn Time | Burn Length |
| Test 1 | 1.4 | 2.3 | 0.0 | 0.0 |
| Test 2 | 1.2 | 2.3 | 0.0 | 0.0 |
| Test 3 | 0.8 | 2.0 | 0.0 | 0.0 |
| Average | 1.1 | 2.2 | 0.0 | 0.0 |

TABLE II

| Sample No. | Sample Comp. | Composition | Densification Method | Burn Length (in.) | After Flame (sec.) | Flame Drop (sec) | Pass or Fail |
|---|---|---|---|---|---|---|---|
| 1 | NCF/PEB/PE | 30/20/51 | NP | 1.5/1.5/1 | 0/0/0 | 0/0/0 | passed |
| 2 | NCF/PEB/PE | 30/20/50 | PS | .5/.75.5 | 0/0/0 | 0/0/0 | passed |
| 3 | Nomex TM /PEB/PE | 20/20/60 | NP | total | 30 sec. | 2 sec. | failed |
| 4 | Nomex TM /PEB/PE | 50/20/30 | NP | total | 40 sec. | — | failed |
| 5 | NCF/PEB/PE | 20/20/60 | NP | 2/2/2 | 0/0/0 | 0/0/0 | passed |
| 6 | NCF/PEB/PE | 20/20/60 | PS | 1.5/1.5/1.5 | 0/0/0 | 0/0/0 | passed |
| 7 | NCF/PEB/Cotton | 30/15/55 | NP | 1/1/1 | 0/0/0 | 0/0/0 | passed |
| 8 | NCF/PEB/Cotton | 30/5/55 | — | .5/.5/.5 | 0/0/0 | 0/0/0 | passed |
| 9 | NCF/PEB/Cotton | 30/15/55 | NP | .75/.75/.75 | 0/0/0 | 0/0/0 | passed |
| 10 | NCF/PEB/Cotton | 30/15/15 | PS | 1.25/1.5/1.25 | 0/0/0 | 0/0/0 | passed |
| 11 | Kevlar TM /PEB/PE | 50/20/30 | — | .5/.5/.5 | 0/0/0 | 0/0/0 | passed |
| 12 | Kevlar TM /PEB/PE | 50/20/30 | NP | 3.5/3/3.5 | 0/0/0 | 0/0/0 | passed |
| 13 | Kevlar TM /PEB/PE | 50/20/30 | PS | 1.25/1.5/1.5 | 0/0/0 | 0/0/0 | passed |
| 14 | Kevlar TM /PEB/PE | 20/20/60 | — | 12 | complete burn | | failed |
| 15 | Kevlar TM /PEB/Cotton | 50/15/35 | — | 15/.5/.5 | 0/0/0 | 0/0/0 | passed |
| 16 | Kevlar TM /PEB/Cotton | 50/15/35 | NP | .5/.5/.5 | 0/0/0 | 0/0/0 | passed |
| 17 | Kevlar TM /PEB/cotton | 50/15/35 | PS | .75/.75/.75 | 0/0/0 | 0/0/0 | passed |

NP = needle punched at 100 punches/in$^2$
PS - Pin Sonic Thermally Bonded in diamond pattern

EXAMPLE 4

Flammability tests were conducted in accordance with FAA approve, "Airline Fabricare Flame Blocking Test Procedures" dated 9, January 1985.

To pass this test the average percentage weight loss may not exceed 10%; the char length (burn across) must be less than 17 inches; and at least two of the three specimens must pass the tests in all respects.

A. A standard HR fire resistant urethane foam (1,6 lb/ft 3) was covered with a standard blocking layer (4

Conclusions

All specimens passed the test.

What is claimed is:

1. A non-woven fire retarding and fire blocking covering for a foam seat cushion structure comprising an intimate blend of a binder and 25–75% by weight of fibers comprising heat set non-linear, non-graphitic carbonaceous fibers having a LOI value greater than 40, a reversible deflection ratio of greater than 1.2:1, and an aspect ratio greater than 10:1, said carbonaceous fibers being derived from heat treated stabilized polymeric fibers or pitch based fibers.

2. The covering of claim 1, wherein said carbonaceous fibers have a sinusoidal configuration.

3. The covering of claim 1, wherein said carbonaceous fibers have a coil-like configuration.

4. The covering of claim 1, wherein said carbonaceous fibers are derived from stabilized acrylic fibers.

5. The covering of claim 1, wherein said carbonaceous fibers are derived from stabilized polyacrylonitrile fibers.

6. The covering of claim 1, comprising carbonaceous fibers having a nitrogen content of about, 18 to about 20%.

7. The covering of claim 1, further comprising a natural fiber selected from the group consisting of cotton, wool, flax, silk and mixtures thereof.

8. The covering of claim 1, wherein said binder is a polyester.

9. The covering of claim 1, further comprising synthetic fibers blended with said carbonaceous fibers.

10. The covering of claim 9 wherein said synthetic fibers are selected from the group consisting of polyolefin, polyester, polyacrylonitrile, polyvinyl chloride and ionomers.

11. A fire retarding and fire blocking non-woven fabric covering for a foam set cushion composing an intimate blend of 25 to 75% by weight of heat set, non-linear, non-graphitic carbonaceous fibers having an LOI value greater than 40, synthetic fibers and a binder.

12. The covering of claim 11, further comprising natural fibers in said blend said carbonaceous fibers having a reversible deflection ratio of greater than 1.2:1 an aspect ratio greater than 10:1.

13. The covering of claim 11, wherein said binder is a polyester.

* * * * *

UNITED STATES PATENT AND TRADEMARK OFFICE

CERTIFICATE OF CORRECTION

PATENT NO. : 4,943,478

DATED : July 24, 1990

INVENTOR(S) : Francis P. McCullough, Jr., R. Vernon Snelgrove

It is certified that error appears in the above-identified patent and that said Letters Patent is hereby corrected as shown below:

On the title page item [56] References Cited, under U.S. PATENT DOCUMENTS; --4,412,675 11/1983 Kawakubo-- should be added between 4,356,228 and 4,460,650.

--4,643,931 2/1987 McCullough, Jr. et al.-- should be added between 4,565,727 and 4,659,616.

Column 8, line 10; "foam set" should read --foam seat--.

Column 8, line 13; change "and a binder." to read --and a binder said carbonaceous fibers having a reversible deflection ratio greater than 1.2:1 and an aspect ratio greater than 10:1.--.

Column 8, line 14 and 15; to read --The covering of claim 11, further comprising natural fibers in said blend.--.

Signed and Sealed this

Fifth Day of May, 1992

*Attest:*

DOUGLAS B. COMER

*Attesting Officer*

*Acting Commissioner of Patents and Trademarks*